US007823565B2

(12) United States Patent
Chern et al.

(10) Patent No.: US 7,823,565 B2
(45) Date of Patent: Nov. 2, 2010

(54) FUEL INJECTION SYSTEM FOR INTERNAL COMBUSTION ENGINE WITH INJECTOR ISOLATOR RING

(75) Inventors: Yitzong Chern, Troy, MI (US); Deanna Hoffman, Ann Arbor, MI (US); Mario Joseph Felice, Dearborn Heights, MI (US); Steven Homco, Canton, MI (US); Joseph Stout, Royal Oak, MI (US)

(73) Assignee: Ford Global Technologies, Dearborn, MI (US)

( * ) Notice: Subject to any disclaimer, the term of this patent is extended or adjusted under 35 U.S.C. 154(b) by 0 days.

(21) Appl. No.: 12/412,559

(22) Filed: Mar. 27, 2009

(65) Prior Publication Data

US 2010/0175667 A1 Jul. 15, 2010

Related U.S. Application Data

(60) Provisional application No. 61/144,520, filed on Jan. 14, 2009.

(51) Int. Cl.
*F02M 61/14* (2006.01)

(52) U.S. Cl. ..... 123/470; 123/192.1

(58) Field of Classification Search ..... 123/467, 123/470, 192.1
See application file for complete search history.

(56) References Cited

U.S. PATENT DOCUMENTS 3,038,456 A * 6/1962 Dreisin ..... 123/470
6,543,421 B2 * 4/2003 Lorraine et al. ..... 123/470
6,805,103 B1 * 10/2004 Sumida et al. ..... 123/470
6,840,226 B2 * 1/2005 Hans ..... 123/470
6,899,087 B2 * 5/2005 Norgauer ..... 123/470
6,953,162 B2 * 10/2005 Hans ..... 239/585.1
7,293,550 B2 * 11/2007 Beardmore ..... 123/470
7,373,925 B2 * 5/2008 Reiter et al. ..... 123/470
7,444,992 B2 * 11/2008 Ricci ..... 123/470
7,484,499 B2 * 2/2009 Beardmore ..... 123/470
7,513,242 B2 * 4/2009 Morris ..... 123/470
7,523,742 B2 * 4/2009 Tsuchiya et al. ..... 123/470
2004/0094129 A1 * 5/2004 Raimann ..... 123/470
2008/0035114 A1 * 2/2008 Kawasumi ..... 123/467
2008/0156298 A1 * 7/2008 Brauneis et al. ..... 123/470
2009/0071445 A1 * 3/2009 Mueller et al. ..... 123/470
2010/0018502 A1 * 1/2010 Fischetti et al. ..... 123/470
2010/0175668 A1 * 7/2010 Chern et al. ..... 123/470

* cited by examiner

*Primary Examiner*—Hai H Huynh
(74) *Attorney, Agent, or Firm*—Jerome R. Drouillard; Julia Voutyras

(57) ABSTRACT

A fuel injection system for internal combustion engine includes an injector mounted within a pocket formed in the cylinder head, and an isolator which defines a radial clearance gap with the injector pocket. The isolator expands radially outwardly into a clearance gap in response to axially directed force imposed upon the isolator by the injector, so that a dual rate force/displacement effect is achieved by the isolator.

8 Claims, 4 Drawing Sheets

FUEL INJECTION SYSTEM FOR INTERNAL COMBUSTION ENGINE WITH INJECTOR ISOLATOR RING

CROSS REFERENCE TO RELATED APPLICATIONS

This application claims priority from U.S. Provisional patent application 61/144,520, Filed on Jan. 14, 2009, which is hereby incorporated by reference in its entirety.

BACKGROUND OF THE INVENTION

1. Field of the Invention

The present invention relates to an internal combustion engine having fuel injectors mounted within a cylinder head and spraying fuel into the engine's combustion chambers.

2. Related Art

Most spark ignited internal combustion engines used in automotive vehicles have employed fuel systems with either a carburetor, or more recently, multiple fuel injectors mounted in an intake manifold or within individual intake ports. Each of these systems provides fuel to the engine via the intake manifold. Although manifold/port mounted fuel injectors have generally been satisfactory, and indeed, a great improvement as compared with carburetor systems, automotive designers are increasingly moving to the use of direct fuel injection with spark ignited engines. With a direct injection system, fuel injectors are typically mounted through the fire deck of the engine's cylinder head and provide fuel directly into each of the engine's combustion chambers.

As used with spark ignition engines, direct injection has been found to be beneficial in terms of improved fuel economy, coupled with reduced exhaust emissions. Although direct injection has been used in many types of diesel engines for years, this new application of direct injection in gasoline engines intended for use in automotive vehicles has created a problem because the higher pressures utilized with direct injection have caused unwanted noise or "tick" while the engine is idling; under certain cases the tick may become more pronounced at high speeds and loads. This tick noise, resulting from injector needle impact, has not generally been a problem with most diesel engines, but has definitely proved to be an issue with direct-injected spark ignited engines, as well as with some diesel engines.

It would be desirable to provide a system allowing a low noise signature for gasoline and diesel direct injection fuel systems, while at the same time preserving the durability of fuel injectors. This presents a challenge, because if the injector's mounting is softened to the point where ticking noise is attenuated at idle, the corresponding movement of the injector within the cylinder head's injector pocket at high loads may cause adverse durability affects upon injector tip seals.

SUMMARY OF THE INVENTION

According to an aspect of the present invention, a fuel injection system for an internal combustion engine includes a cylinder head having an injector pocket formed in the cylinder head, with the pocket having a lower wall and an outer wall. A fuel injector is mounted within the injector pocket, with the injector having an injector base. An isolator is mounted between the injector base and the lower wall of the injector pocket. The isolator includes a generally annular isolator base in contact with the lower wall. A contact surface extends upwardly from the generally annular base, with the contact surface defining a radial clearance gap with the outer wall of the injector pocket. A wedging injector contact surface, which is part of the isolator's contact surface, is in contact with the injector base so that forces imposed axially by the injector upon the isolator cause the isolator to expand radially outwardly into the radial clearance gap in response to axially directed forces. This causes the axially directed force/deflection rate of the isolator to increase monotonically. In essence, the force/deflection response of the isolator in a direction parallel to the central axis of the injector will increase from a first rate, responsive to smaller injector displacements, to a second, higher rate, responsive to larger injector displacements. This rate increase is caused by the isolator's radial expansion into contact with the injector pocket's outer wall.

According to another aspect of the present invention, the isolator's contact surface, extending upwardly from the generally annular base is generally conical, so that the conical contact surface is supported by the outer wall when axial force imposed by the injector upon the isolator exceeds a predetermined threshold value. The static value of the radial clearance gap is graduated, with the gap having a minimum static length adjacent the base of the isolator, and a maximum static value adjacent the uppermost portion of the isolator.

It is an advantage of a fuel injection system according to the present invention that objectionable ticking noise, which is particularly prevalent in engines having direct cylinder injectors, will be avoided, while at the same time protecting injector tip seals from harm which could otherwise occur as a result of an overly compliant mounting system.

It is an advantage of a system according to the present invention that a dual rate load deflection curve is established for the response of the injector mount to the pressures imposed upon the injector, during operation of the injector at any regime from idle to full output.

It is yet another advantage of a fuel injection system according to the present invention that the isolator used in the present system is readily tunable to accommodate changes in engine operating parameters.

Other advantages, as well as features of the present invention, will become apparent to the reader of this specification.

DETAILED DESCRIPTION OF THE PREFERRED EMBODIMENTS

Figure 1:
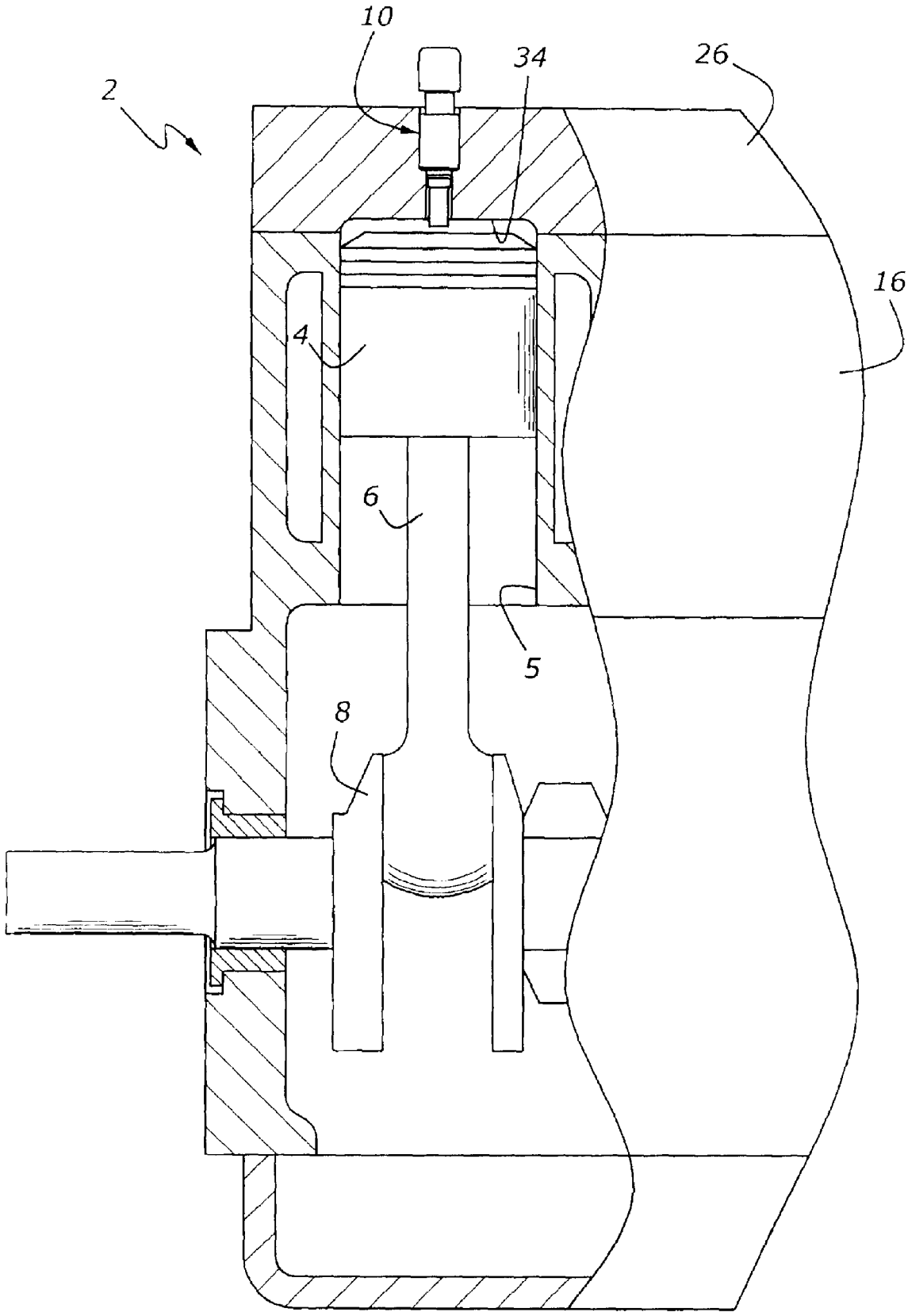
FIG. 1 is a schematic representation of a portion of an engine having a fuel injection system according to the present invention.

FIG. 1 illustrates an engine, 2, having a crankshaft, 8, with a piston, 4, and a connecting rod, 6, attached thereto, for reciprocating motion within a cylinder, 5, formed in a cylinder block, 16. A cylinder head, 26, is mounted at the top of engine 2. A fuel injector, 10, is mounted through cylinder head 26 so as to supply fuel directly to the combustion chamber defined by cylinder head 26 and piston 4.

Figure 2:
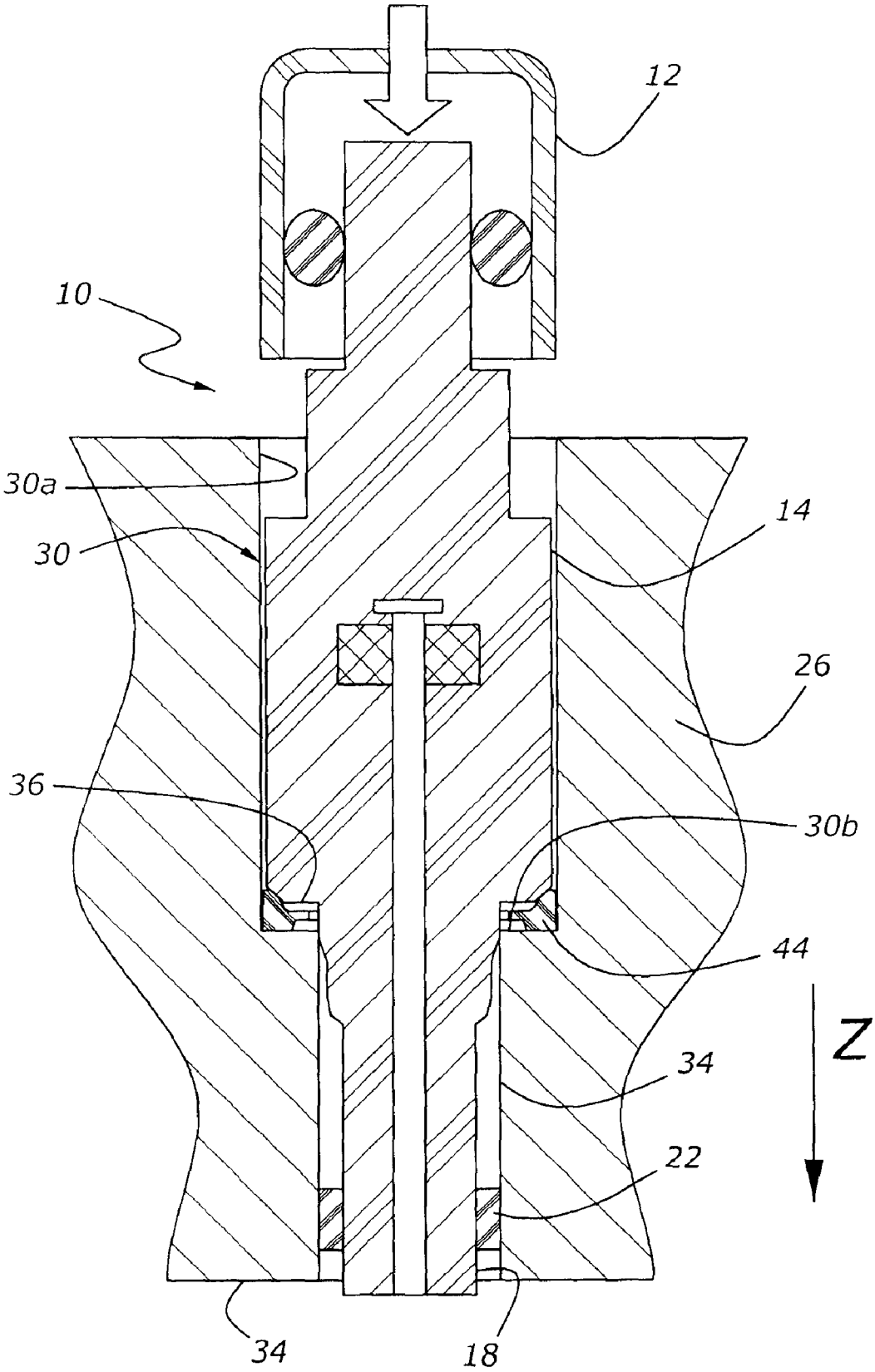
FIG. 2 is a partially schematic representation of an injector mounted in a cylinder head according to an aspect of the present invention.

FIG. 2 is a partially schematic representation of a fuel injection system having an injector isolator according to an aspect of the present invention. Fuel injector 10 receives fuel through a supply system including a fuel rail cap, 12, which is mounted to the top of injector 10. Injector 10 has a generally cylindrical outer body, 14, which is mounted within an injector pocket, 30, formed in cylinder head, 26. Injector 10 has a tip, 18, with a tip seal, 22, which is preferably formed from a plastics material such as polytetrafluoroethylene. Injector tip 18 extends through fire deck 34 of cylinder head 26. Because fire deck 34 and the upper surface of piston 4 configure a combustion chamber, injector 10 is deemed to be a direct injector. Tip seal integrity is important because tip seal 22 prevents high pressure gases from leaking from the combustion chamber past injector 10.

Injector pocket 30 has an outer wall, 30*a*, which is generally cylindrical, and a lower wall, 30*b*, which is generally annular. Injector 10 is mounted within injector pocket 30 including surfaces 30*a* and 30*b*, with an isolator, 44, being mounted between injector 10 and lower wall 30*b* of injector pocket 30.

Figure 3:
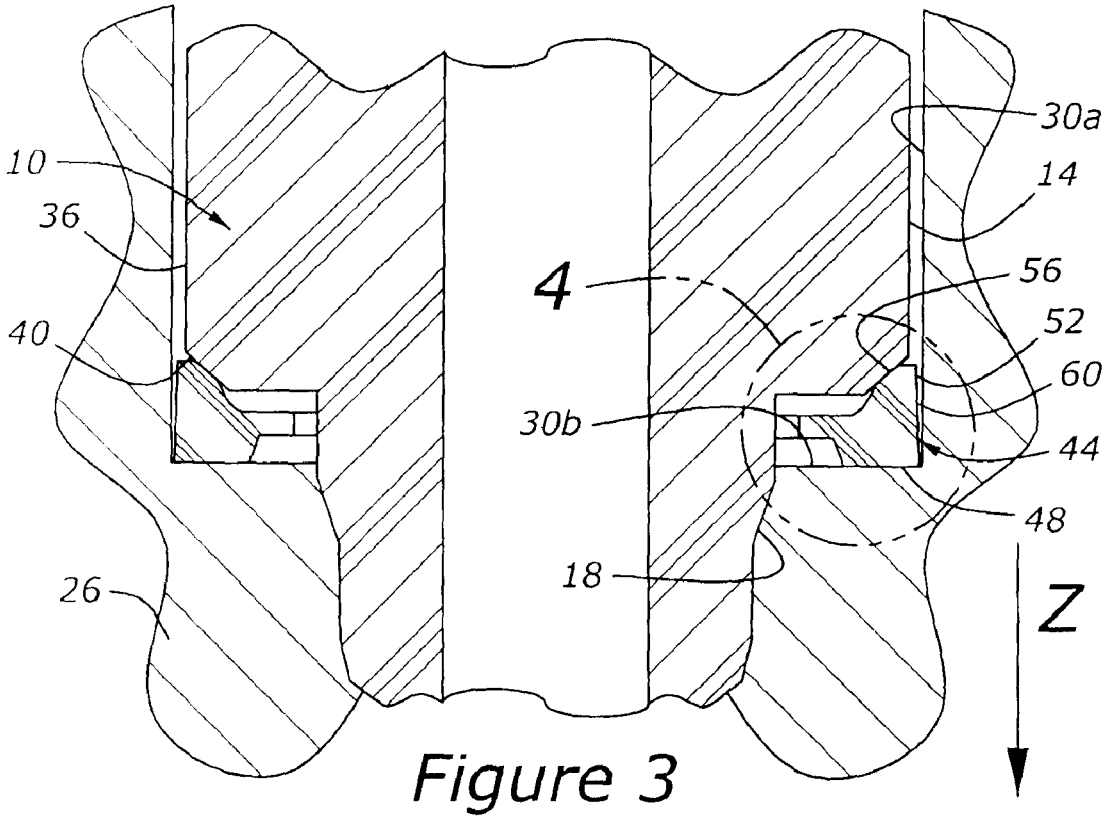
FIG. 3 shows a portion of the injector of FIG. 2 with specificity related to the isolator portion of the injector mounting system.
Figure 4:
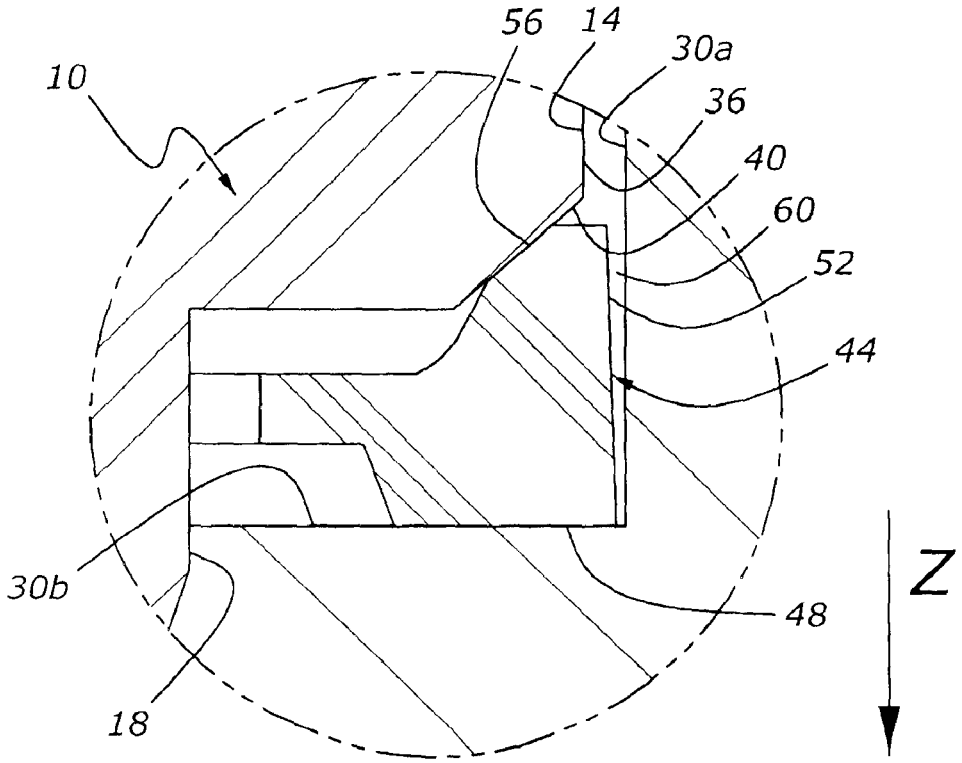
FIG. 4 is an enlargement of a portion of FIG. 3, showing an isolation system in greater detail, while operating at lower axial loading from the injector.
Figure 5:
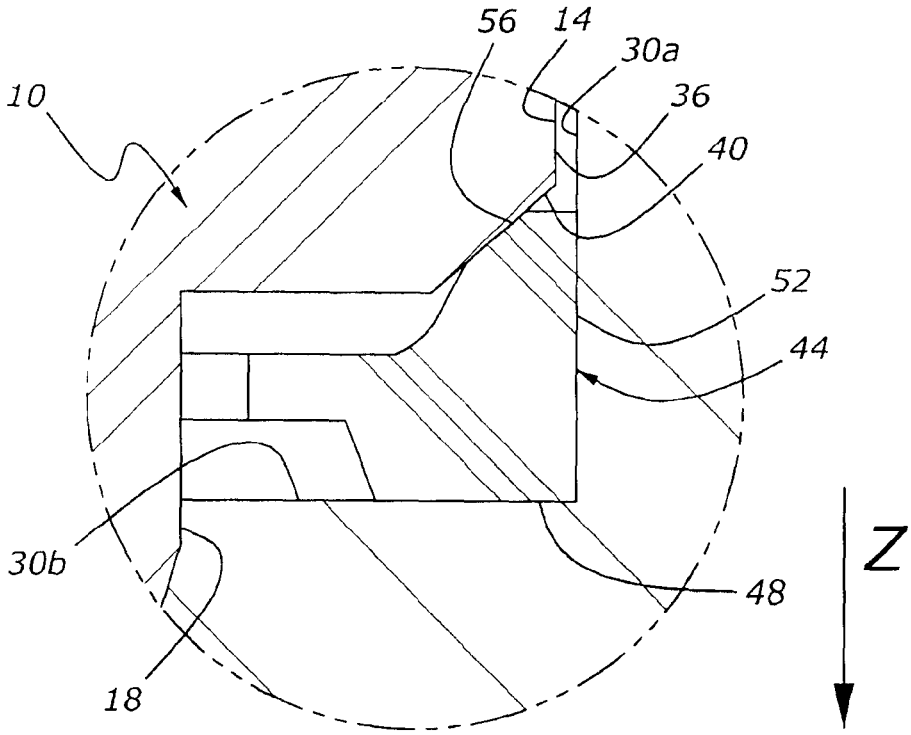
FIG. 5 shows the isolation system of FIG. 4 in a compressed state corresponding to high load operation.

FIGS. 3, 4, and 5 illustrate various details of isolator 44 and show its interaction with injector 10 and with injector pocket 30, as embodied by surfaces 30*a* and 30*b*. Isolator 44 has a generally annular base, 48, which is in contact with lower wall 30*b* of injector pocket 30. A conical contact surface, 52, extends upwardly from isolator base 48 and, together with outer wall 30*a* of injector pocket 30, defines a radial clearance gap, 60, which extends between conical contact surface 52 and outer wall 30*a*. Radial gap 60 is graduated, and has a minimum static length adjacent base 48 and a maximum value adjacent the uppermost portion of conical contact surface 52.

Isolator 44 has a wedging injector contact surface, 56, located at an upper portion of isolator 44, which interacts with a corresponding wedge-shaped lower portion, 40, of injector 10, so as to cause isolator 44 to expand radially outwardly into clearance gap 60 in response to axially directed force imposed upon isolator 44 by wedge-shaped lower portion 40 of injector 10. The axial direction is indicated by arrows Z in the various drawings. When isolator 44 expands radially outward sufficiently, conical contact surface 52 will be supported by outer wall 30*a*; this occurs when axial force imposed by injector 10 upon isolator 44 exceeds a predetermined threshold.

The graduated characteristic of radial clearance gap 60 promotes a graduated response by isolator 44 to axially imposed loading from injector 10. In essence, isolator 44 will be caused to gradually expand outward to contact outer wall 30*a* of pocket 30 as the axially imposed force increases. When sufficient force has been imposed upon isolator 44 by injector 10, conical contact surface 52 will be fully engaged with injector pocket outer wall 30*a*, as shown in FIG. 5. In essence, when this operating regime has been reached, isolator 44 is stacked solid, and motion of injector 10 with respect to pocket 30 will be restricted. In this manner, the aforementioned ticking noise will be mitigated, without causing adverse durability concerns with seal 22, shown in FIG. 2.

Figure 6:
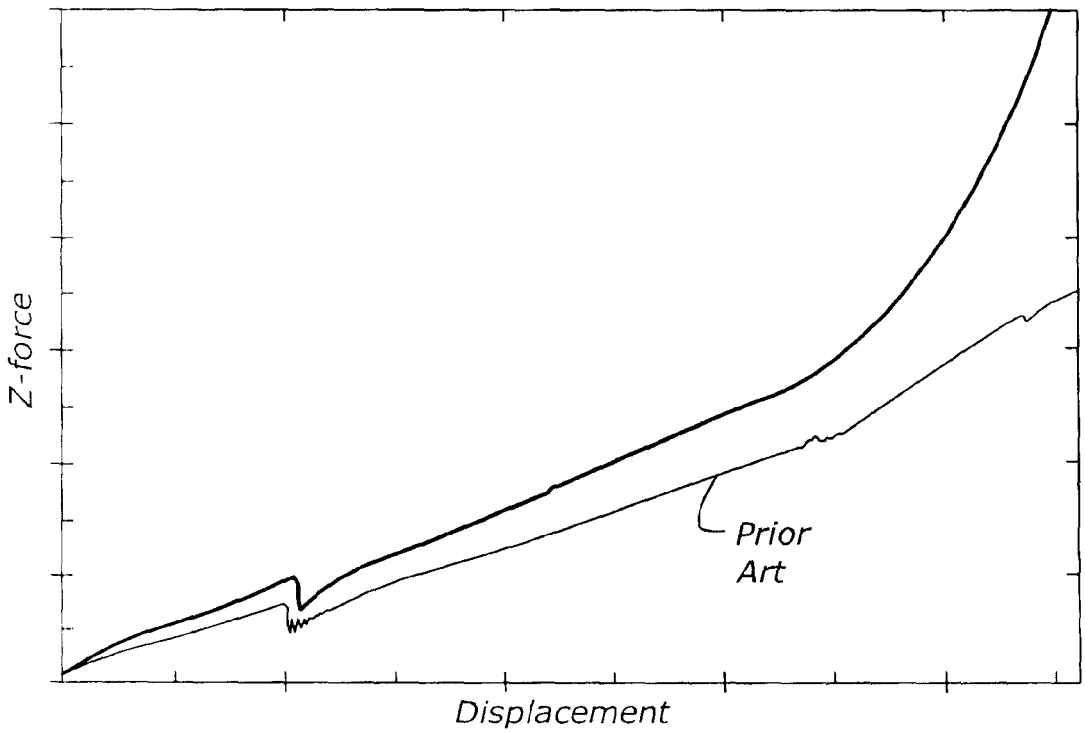
FIG. 6 shows a force/displacement curve for both a prior art isolator and a device according to the present invention.

A beneficial effect of the current design is shown in FIG. 6. The lower curve in FIG. 6, for a prior art isolator, shows that for a given force in the Z direction, a certain displacement of injector 10 in the downward direction is achieved. The slope of the force/displacement curve is relatively invariant. The upper plot of FIG. 6, however, is for an isolator configured according to the present invention, which shows much more resistance to displacement at very much higher axially imposed forces, as evidenced by the increasingly positive slope of the curve. As a result, the inventive isolator produces good attenuation of idle tick, while preventing undesirable motion and therefore, deterioration of seal 22, as injection pressures increase.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A fuel injection system for an internal combustion engine, comprising:

a cylinder head;

an injector pocket formed in said cylinder head, with said pocket having a lower wall and an outer wall;

a fuel injector mounted within said injector pocket, with said injector having an injector base; and an isolator mounted between said injector and said lower wall of said injector pocket, with said isolator comprising:

an isolator base in contact with said lower wall;

a generally conical contact surface extending upwardly from said generally annular base, with said contact surface defining a radial clearance gap with said outer wall of said injector pocket; and a wedging injector contact surface for causing the isolator to expand radially outwardly into said clearance gap in response to axially directed force imposed upon the isolator by said injector base, with said isolator exhibiting an axially directed force/deflection characteristic having a lower value when a minimal amount of the conical contact surface has expanded into contact with said outer wall of said injector pocket, with said force/deflection characteristic having a greater value when a maximum amount of the conical contact surface has expanded into contact with the outer wall of the injector pocket.

2. A fuel injection system according to claim 1, wherein said isolator is configured to expand radially outward so that said conical contact surface is supported by said outer wall when axial force imposed by the injector upon the isolator exceeds a predetermined threshold.

3. A fuel injection system according to claim 1, wherein the static value of said radial clearance gap is graduated, with said gap having a minimum static length adjacent the base of the isolator, and a maximum static value adjacent an uppermost portion of the isolator.

4. A fuel injection system according to claim 1, wherein said injector base has a wedge-shaped lower portion abutting said injector contact surface of said isolator.

5. A fuel injection system according to claim 1, wherein said isolator comprises solid polytetrafluoroethylene.

6. A fuel injection system according to claim 1, wherein said isolator has a generally annular base in contact with the lower wall of said injector pocket.

7. A fuel injection system for an internal combustion engine, comprising:

a cylinder head;

an injector pocket formed in said cylinder head, with said pocket having a lower wall and an outer wall;

a fuel injector mounted within said injector pocket, with said injector having an injector base; and an axially compressible isolator mounted between said injector base and said lower wall of said injector pocket, with said isolator comprising:

a generally annular base in contact with said lower wall;

a generally conical, compressive contact surface extending upwardly from said generally annular base, with said contact surface defining a radial clearance gap with said outer wall of said injector pocket; and an injector contact surface for causing the isolator to expand radially outwardly into said clearance gap and into compressive contact with said outer wall in response to axially directed force imposed upon the isolator by said injector base, whereby an axially directed force/deflection rate of the isolator will increase monontonically, wherein said axially directed force/deflection rate increases at a generally invariant, lower rate for smaller displacements of the isolator, with the force/deflection rate increasing at a higher rate for larger displacements of the isolator.

8. A fuel injection system for an internal combustion engine, comprising:

a cylinder head;

an injector pocket formed in said cylinder head, with said pocket having a lower wall and an outer wall;

a fuel injector mounted within said injector pocket, with said injector having an injector base and a central axis; and an isolator mounted between said injector and said lower wall of said injector pocket to control axial displacements of the injector driven by needle impact, with said isolator comprising:

an isolator base in contact with said lower wall;

a contact surface extending upwardly from said generally annular base, with said contact surface defining a radial clearance gap with said outer wall of said injector pocket; and a wedging injector contact surface for causing the isolator to expand radially outwardly into said clearance gap in response to axially directed force imposed upon said wedging injector contact surface by said injector base, whereby a force/deflection response of the isolator in a direction parallel to the central axis of the injector will increase from a first rate, responsive to smaller injector displacements, to at least a second, higher, rate responsive to larger injector displacements.

* * * * *